United States Patent [19]

Saveland

[11] Patent Number: 5,016,499

[45] Date of Patent: May 21, 1991

[54] BEVERAGE BOTTLE STOPPER REMOVER

[76] Inventor: Lee Saveland, P.O. Box 7893, Auburn, Calif. 95604

[21] Appl. No.: 579,565

[22] Filed: Sep. 10, 1990

[51] Int. Cl.[5] ..... B67B 7/06

[52] U.S. Cl. ..... 81/3.37; 81/3.29

[58] Field of Search ..... 81/3.37, 3.07, 3.4, 81/3.36, 3.29; 29/267

[56] References Cited

U.S. PATENT DOCUMENTS

| | | | |
|---|---|---|---|
| 280,697 | 7/1883 | White | 81/3.29 |
| 2,761,338 | 9/1956 | Hardy | 81/3.29 |
| 3,800,345 | 4/1974 | Feliz | 81/3.37 |
| 4,598,613 | 7/1986 | Baum | 81/3.37 |
| 4,680,993 | 7/1987 | Feliz | 81/3.37 |
| 4,729,267 | 3/1988 | Giebeler | 81/3.37 |
| 4,798,106 | 1/1989 | Foster | 81/3.29 |
| 4,947,711 | 8/1990 | Giebeler | 81/3.37 |

FOREIGN PATENT DOCUMENTS

| | | | |
|---|---|---|---|
| 10606 | 9/1901 | Norway | 81/3.37 |

*Primary Examiner*—Roscoe V. Parker
*Attorney, Agent, or Firm*—Mark C. Jacobs

[57] ABSTRACT

An opener for the easy removal of a stopper from a champagne-type bottle unidirectionally, which opener comprises a frame having a closed front and an open rear, a first shaft at the rearward end, and a second shaft at the forward end. The second shaft is coupled to a rack at one end and to a platform adapted to engage the underside of a stopper at the other end. The rack is raised by the downward movement of a handle having a pinion at one end which engages the rack and thereby simultaneously pushes the platform upwardly on the stopper to remove it.

7 Claims, 2 Drawing Sheets

BEVERAGE BOTTLE STOPPER REMOVER

BACKGROUND OF THE INVENTION

The present invention relates to a bottle opener and, more particularly, to an opener for the removal of stoppers from champagne-type bottles.

Openers for the pulling of corks from bottles is a well developed art. A large number of different constructions have been employed to carry out this function. The most famous of which is of course the corkscrew. The basic units provide a corkscrew which is screwed into the cork and which is then pulled from the bottle.

A more preferred means of a pulling mechanism is the well know rack and gear combination, such as may be found in such exemplary patents as U.S. Pat. Nos. 1,753,026; 2,115,289 and 4,063,473 among others. These have the advantage of straight-line removal of the cork from the bottle with hopefully minimum effort. As with anything else, each of these constructions has its shortcomings as well.

The problem comes up in dealing with stoppered bottles as opposed to corked bottles. Corkscrews simply won't work with these molded plastic stoppers, primarily because the molded parts are hollow inside, so there is nothing for the screw of the corkscrew to hold onto. Thus there is a need for a low cost easy to use champagne bottle stopper remover.

In carrying out a search on this invention, applicant became aware of the Feliz U.S. Pat. No. 4,680,993, and the Baum U.S. Pat. No. 4,598,613 which was cited in Feliz. Other U.S. patents representative of the art in the field include the following:

| | | | |
|---|---|---|---|
| 4,018,110 | Spiggs | 4,590,821 | Olson |
| 4,387,609 | Poisfuss | 4,606,245 | Veverka |
| 4,422,355 | Burns | 4,729,267 | Gebeler |
| 4,519,277 | Raab | 4,750,391 | Sweatt |
| 4,520,696 | Wolze | 4,756,214 | Valtri |

It is an object therefore of this invention to provide a lifting device for the removal of stoppers from champagne and other stoppered bottles which contain natural high pressure gas, such as sparkling wine and apple cider.

It is another object of this invention to provide a stopper remover for champagne-type bottles that uses a rack and pinion system.

It is yet another object to provide a stopper remover that pushes the stopper up from the mouth of the bottle and which requires minimal effort on the part of the user.

A still further object is to provide a stopper remover that operates in a downward straight line motion and which is usable with bottles having various neck configurations and not just one specific type.

Yet another object is to provide a stopper remover that dislodges and holds plastic and cork stoppers and prevents them from flying and hurting someone.

These and other objects of the invention will in part be obvious and will in part appear hereinafter.

The invention accordingly comprises the device possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A stopper remover for use with champagne-type bottles that utilizes a platform actuated by a rack and pinion mechanism to raise a stopper from a champagne-type bottle and to retain said stopper therein for disposal. A down stroke of a handle actuates the rack and pinion.

DESCRIPTION OF THE PREFERRED EMBODIMENT

Figure 1:
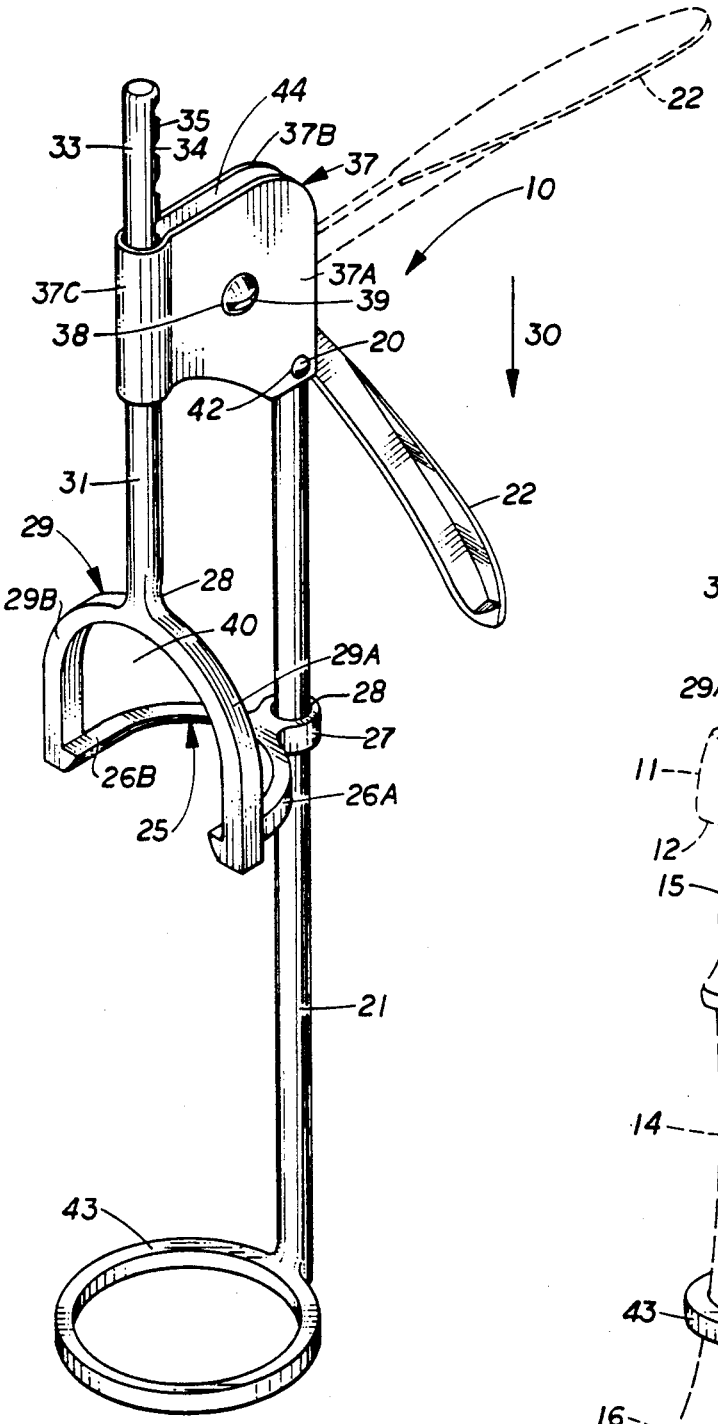
FIG. 1 is a right side perspective view of the device of this invention. The left side is a substantial mirror image thereof.
Figure 2:
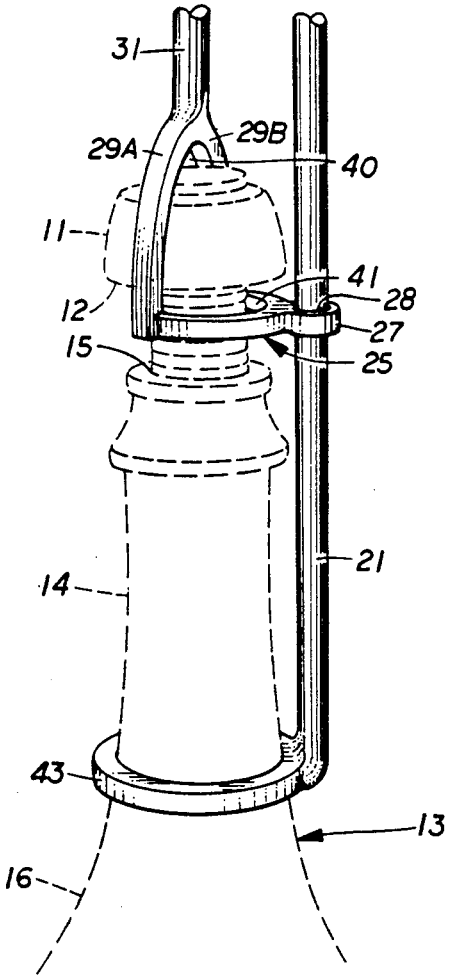
FIG. 2 is a close-up perspective view of a portion of the invention.

In FIG. 1, the device 10 is seen, unmounted on the bottle 13 shown in FIG. 2. Device 10 comprises an elongated shaft 21 which has at its upper end an opening 19, which is aligned with bore 42 in frame member 37's first section 37A. A threaded bolt 20 or other connector is inserted through bore 42 in frame member 37A, through opening 19, in shaft 21 and then through a second bore 42 on the opposite section 37B (not shown) of the frame member for engagement with nut 50 seen in FIG. 4 only.

At the opposite or lower end of shaft 21 is annular neck mount 43 mounted tangentially normal to said shaft. Annular neck mount 43 fits over the neck 14 of bottle 13 per FIG. 2.

Frame member 37 is comprised of two mirror image parallel disposed sections 37A and 37B (per FIG. 4) which are joined to a middle normally disposed section 37C at what is the forward end of the frame member. The frame member 37 has an opening 44 at the rear thereof to permit movement of handle 22 therein. See also FIG. 4.

Figure 4:
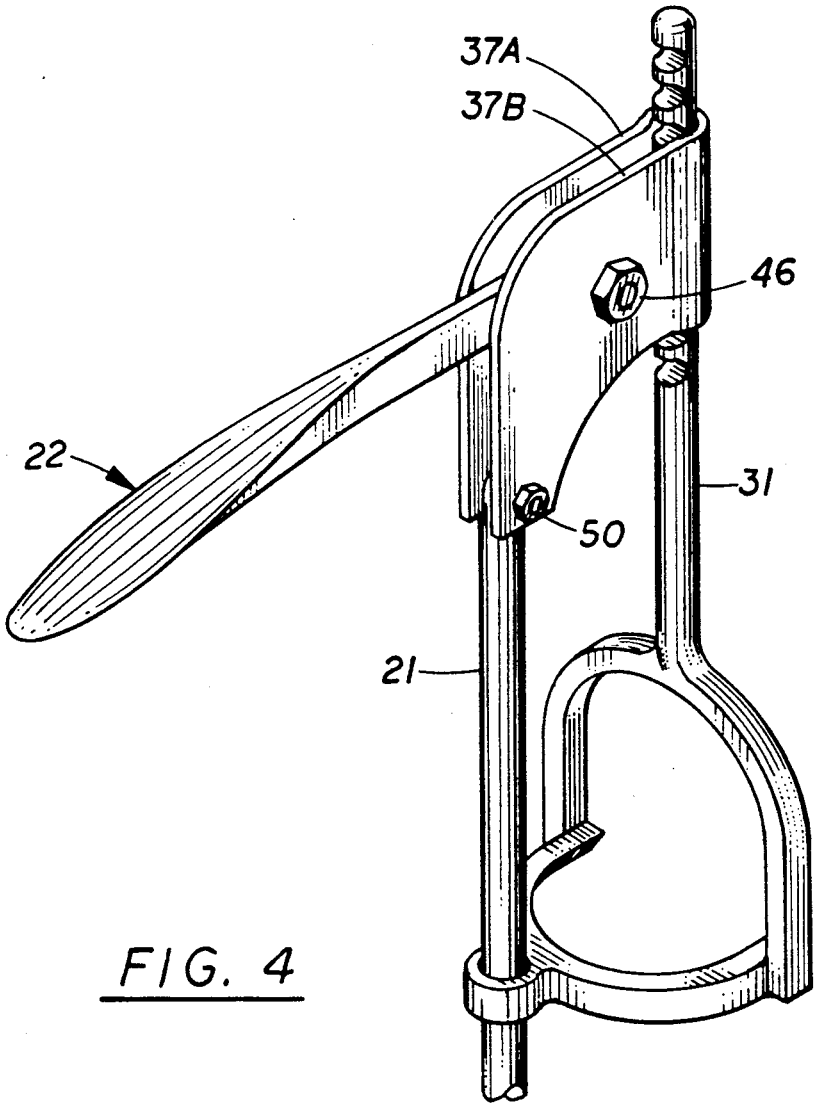
FIG. 4 is a top perspective view of the device of this invention.

A pair of aligned bores 38 are found in the sections 37A and 37B for the receipt of pivot pin 39 which is secured by a nut 46 seen in FIG. 4.

Figure 3:
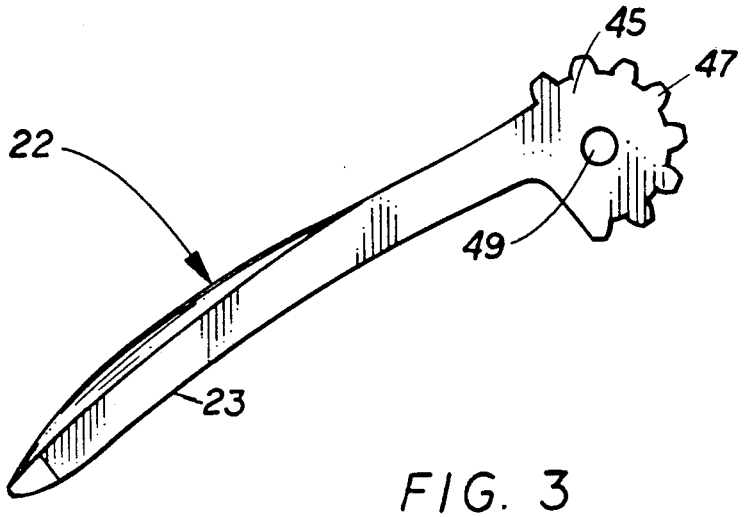
FIG. 3 is a perspective view of the lever handle and rotating gear portion of the invention removed from the assembly.

Handle 22 seen in FIG. 3 includes a lever portion 23 from which a pinion 45 extends forwardly. Pinion 45 includes a plurality of spaced teeth 47. Handle 22 is retained in position by the aforementioned pivot pin 39 which passes through pivot bore 49, and said pin is retained by nut 46. See FIG. 4.

Shaft 31 has a rack 33 at its upper or first end, a part of which rack is disposed within frame member 37 and is thus unseen. Rack 33 includes spaced teeth 35 separated by notches 34. Pinion 45 is disposed at a location within said frame member 37 such as to engage rack 33. Thus shaft 31 is retained generally parallel to shaft 21 for the reasons to be discussed below.

Shaft 31 includes an axially aligned yoke 29 formed from arcuate yoke members 29A and 29B and which extend downwardly therefrom. Yoke 29 may extend directly from shaft 31 or by a short connector member 28 which may be interposed as may be desired. Yoke 29 has an opening between the members 29A, 29B, which opening is designated 40 in FIG. 1. Disposed normal thereto at the ends of yoke 29's segments 29A and 29B is platform 25. This platform or raising member 25 includes a pair of arcuate sections 26A and 26B both of which are disposed at 90 degrees respectively to yoke members 29A and 29B. An opening 41 which is sized to receive stopper 11 therein is disposed between arcuate sections 26A and 26B.

Disposed at the junction of arcuate sections 26A and 26B is an extension 27 extending outwardly therefrom. This extension 27 has a vertical bore 28 therein, sized in cross section to slidingly receive shaft 21 therein. Thus taken together the extension 27 and the arcuate sections 26A, 26B can be considered to be configured as a wishbone as can the arcuate sections 29A and 29B together with shaft 31.

The disposition of shaft 31 with its rack thereon is partially fixed by pinion 45. Positioning of shaft 31 parallel to shaft 21 is ensured by proper sizing of the extension of platform 25 which is fixedly attached as noted to yoke 29.

Movement of the handle 22 downward is limited by the end of elongated shaft 21 at its top most end where it is fixed between frame sides 37A and 37B by bolt 20 through holes 42 and 19. Movement upward of the handle is limited by the ability of the teeth of the pinion to engage teeth of the rack.

USE OF THE INVENTION

In the use of the present invention, neck mount 43 is placed down over the neck 14 of the bottle 13. Since mount 43, is of a closed circular configuration, at some point the neck mount will come to rest, as the neck !4 of the bottle tapers outwardly to the main body portion 16 of the bottle, per FIG. 2. Handle 22 is moved upwardly or downwardly as may be necessary to position platform 25 beneath stopper 11's underside 12. See FIG. 2. Since the openings 40, 41 are sized to permit entrance of the stopper 11 therein, per FIG. 2, the platform 25 can be moved into position by both rocking shaft 21 to and fro after placement of the neck mount 43 into position, with the handle held at the correct location to permit the actual placement of the platform 25's platform members 26A and 26B adjacent the underside 12 of the stopper 11. Platform 25 preferably has a flat upper surface to easily engage stopper 11's underside 12.

Upon movement of the handle 22 from the dotted line "up" position 22 downward per arrow 30 to the lower position as shown in FIG. 1, the platform is raised up as the pinion's teeth 47 engage the rack's slots 34 to raise the rack. When this transpires, the platform 25's two members 26A and 26B raise the stopper upward. A single downward stroke along directional arrow 30 is all that is needed to raise the stopper from its position in the mouth 15 of the bottle 13. After this removal step is completed, the stopper 11 will remain on the platform members 26A, 26B for ready discard.

Thereafter the device 10 is raised off of the neck 14 of the bottle 13 such that the beverage, be it champagne, sparkling wine or sparkling cider can be served and enjoyed by one and by all.

Device 10 may be made of any suitable materials such as chrome plated steel or aluminum, or bronze suitable for such purposes.

The lever action of this device has the capacity to maintain the stopper in a perpendicular axis during the removal of operation thereby preventing the stopper from binding within the neck 14. The employment of a gear system, here rack and pinion, serves to reduce the effort necessary to remove the stopper from the bottle.

It can be appreciated therefore that the device of this invention can be used in such a manner to either remove the stopper all the way, or in instances of large social gatherings such as weddings and graduations, to merely pry up the stopper while permitting it to remain in an inserted position for quick removal on a moment's notice. This serves to preserve the fizz, since pressure is maintained within the beverage bottle.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A device for the removal of a stopper having an accessible underside, from a champagne-type bottle which comprises in combination:

a. a frame having two side walls, and a front wall, and being open at the rear, b. a first generally vertical shaft secured at one end to the frame member between the two side walls distant from said front wall;

c. a second generally vertical shaft having a rack disposed at one end thereof in the same axis with said second shaft, said rack disposed within said frame member adjacent the front wall thereof;

d. a platform having an opening therein for receipt of a champagne bottle-type stopper, with said platform configured such that a section of the underside of said stopper rests on said platform, said platform being slidably mounted on said first shaft, and said platform also being connected to said second shaft;

e. a handle comprising a lever having an axially aligned pinion on one end, said pinion end being pivotally mounted within said frame member, and said pinion engaging said rack;

whereby when said handle is moved from an upper position to a lower position the pinion engages the rack thus raising the second shaft and the platform connected thereto, such that the platform pushes up on the underside of the stopper to raise the stopper from the mouth of the bottle.

2. The device of claim 1 wherein the platform comprises a pair of mirror image diverging arcuate members.

3. The device of claim 2 wherein the platform comprises said pair of mirror image diverging arcuate members, connected at their junction to a vertically throughbored extension member, adapted to slide upon said first shaft.

4. The device of claim 1 further including a bottle neck mount at the other end of said first shaft.

5. The device of claim 4 wherein the bottle neck mount is an annular member tangentially mounted at the end of said first shaft, parallel to said platform and directed toward said second shaft.

6. The device of claim 1 wherein said second shaft has an axially aligned yoke depending downwardly therefrom, which yoke is attached to said platform.

7. The device of claim 2 wherein said second shaft has an axially aligned yoke depending downwardly therefrom, one section of which is normally connected to one section arcuate section of said platform, and the other yoke section is connected to the other arcuate section of said platform.

* * * * *